US007201494B2

(12) United States Patent
You et al.

(10) Patent No.: US 7,201,494 B2
(45) Date of Patent: Apr. 10, 2007

(54) LIGHTING SYSTEM OF ADJUSTABLE COLOR TEMPERATURE

(75) Inventors: Ju-Yuan You, Hsinchu (TW); Chien-Liang Yeh, Yilan (TW); Zong-Huai Lee, Changhua (TW); Han-Ping Shieh, Hsinchu (TW); Ko-Wei Chien, Hsinchu (TW); June-Jay Wang, Hsinchu (TW)

(73) Assignee: Opto Tech Corporation, Hsinchu (TW)

( * ) Notice: Subject to any disclaimer, the term of this patent is extended or adjusted under 35 U.S.C. 154(b) by 211 days.

(21) Appl. No.: 11/023,693

(22) Filed: Dec. 27, 2004

(65) Prior Publication Data

US 2006/0139916 A1 Jun. 29, 2006

(51) Int. Cl.
*F21V 9/00* (2006.01)

(52) U.S. Cl. ..... 362/231; 362/293; 362/616

(58) Field of Classification Search ..... 362/231.1, 362/2, 293, 616, 615
See application file for complete search history.

(56) References Cited

U.S. PATENT DOCUMENTS 5,063,479 A * 11/1991 Satoh ..... 362/555
5,812,713 A * 9/1998 Allen et al. ..... 385/39
5,857,761 A * 1/1999 Abe et al. ..... 362/551
6,318,863 B1 * 11/2001 Tiao et al. ..... 353/31
6,540,377 B1 * 4/2003 Ota et al. ..... 362/231
6,655,809 B2 * 12/2003 Suzuki et al. ..... 362/610
6,655,825 B2 * 12/2003 Muthu et al. ..... 362/561

* cited by examiner

*Primary Examiner*—Renee Luebke
*Assistant Examiner*—Gunyoung T. Lee

(57) ABSTRACT

A lighting system capable of adjusting color temperature is provided. The lighting system mainly comprises a light source module and a mixing assembly. The light source module produces red-color, blue-color, and green-color lights so as to control the color temperature of a white light resulted from mixing the color lights. The mixing assembly is located at a side of the light source module and comprises a first, a second, and a third mixing device sequentially arranged along the light transmission path. The function of the first and third mixing devices is for light mixing by causing the lights to undergo multiple internal reflections. The second mixing device directs the lights passing through the first mixing device in a reverse direction (180 degrees) and enters into the third mixing device.

11 Claims, 7 Drawing Sheets

LIGHTING SYSTEM OF ADJUSTABLE COLOR TEMPERATURE

BACKGROUND OF THE INVENTION

1. Field of the Invention

The present invention generally relates to lighting systems and, more particularly, to lighting systems capable of producing high-brightness, high-uniformity white light of the required color temperature.

2. The Prior Arts

Today's lighting systems, which commonly utilize incandescent lamps and halogen lamps, are simple and easy to use. However, they usually require larger input power and their lighting quality often deteriorates after long period of use. As such, new lighting systems for the next generation are continuously developed and proposed. Among them, light-emitting diode (LED) based lighting systems seem to be the most promising one, especially after the white-light LEDs are successfully developed. Under the current technology, however, the white-light LEDs are usually slightly bluish in color, expensive, and have a short operation life. LED-based lighting systems therefore are not commonly adopted yet.

SUMMARY OF THE INVENTION

An objective of the present invention is to provide a lighting system capable of producing lights with high brightness, high uniformity, and adjustable color temperature. The lighting system mainly utilizes a light source module whose mix of red, green, and blue lights is adjustable so as to produce a white light with the required color temperature. The white light then passes through a mixing assembly for a uniform mixing and the final output of the lighting system therefore has the required color temperature, a high brightness, and a uniform color.

Another objective of the present invention is to provide a lighting system having a superior mixing effect and a small form factor. The mixing assembly, based on the total reflection theory, has its reflective surfaces made of a material having a high reflection index. The mixing assembly utilizes at least a mixing device to alter the transmission path of the lights (up to 180 degrees) produced by the light source module. The mixing assembly therefore, on one hand, causes the lights to undergo enough number of times of reflection to achieve a uniform mixing and, on the other hand, effectively reduces the overall dimension of the lighting system.

To achieve the foregoing objectives, the present invention mainly comprises a light source module and a mixing assembly. The light source module is composed of multiple red-color, green-color, and blue-color LEDs. By controlling the current injected into these LEDs, lights resulted from different proportions of red, green, and blue colors, and thereby of the required color temperature, are produced. The mixing assembly comprises a first, a second, and a third mixing device sequentially arranged along the light transmission path. The function of the first and third mixing devices is for light mixing by causing the lights to undergo multiple internal reflections. The second mixing device comprises multiple reflective surfaces so that the lights, after passing through the first mixing device, are reversed in direction (180 degrees) and enter into the third mixing device.

The advantages of the present invention can be summarized as follows: (a) this lighting system of adjustable color temperature could be tuned to suit a geographical region's specific preference (for example, more yellowish white lights for Europe and North America, and whiter white lights for Asia); (b) this lighting system, by using LEDs as light source, has lower power consumption and better luminous efficiency; and (c) this lighting system is more convenient to use due to the reduced form factor.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

In the following, detailed description along with the accompanied drawings is given to better explain preferred embodiments of the present invention. Please be noted that, in the accompanied drawings, some parts are not drawn to scale or are somewhat exaggerated, so that people skilled in the art can better understand the principles of the present invention.

Figure 1:
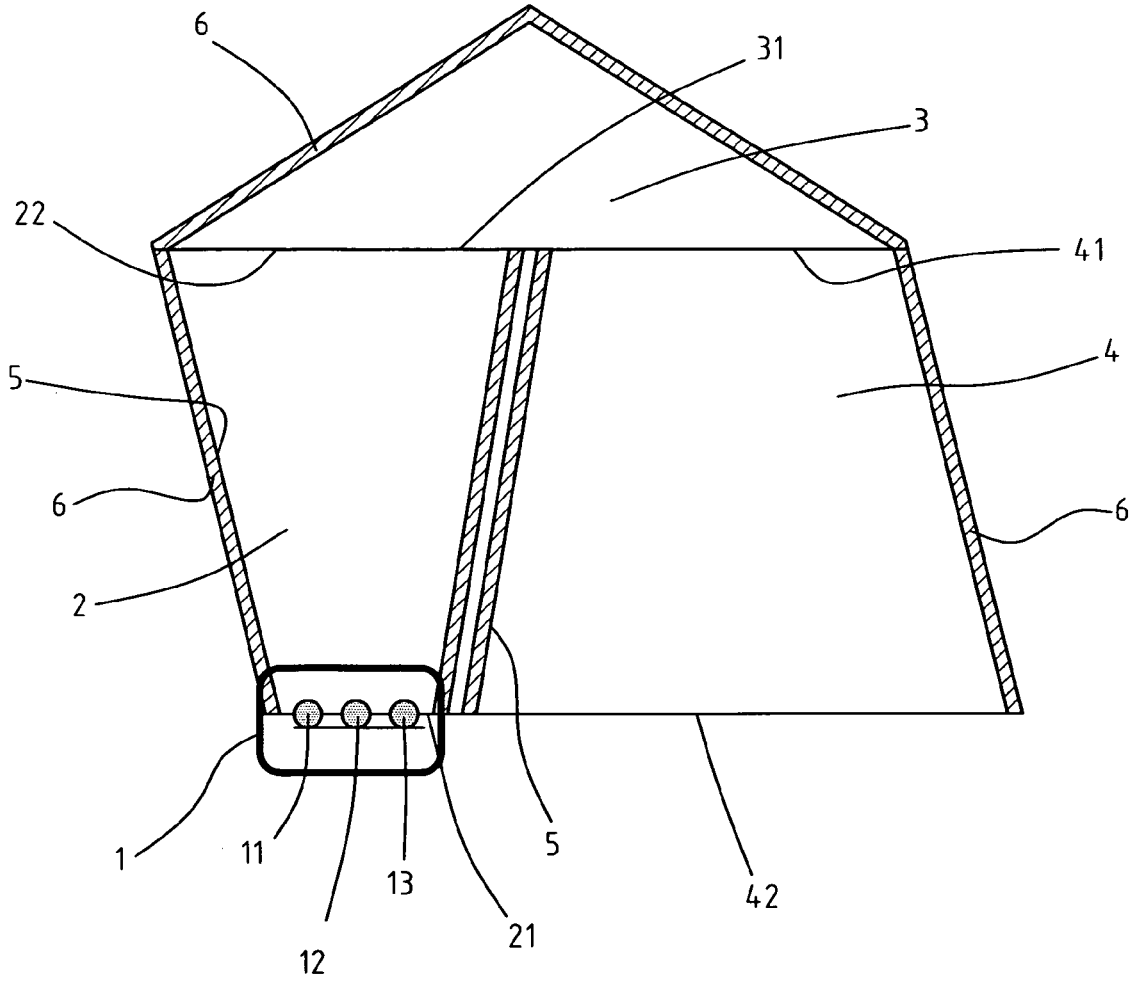
FIG. 1 is a schematic diagram showing a preferred embodiment of the lighting system according to the present invention.

FIG. 1 is a schematic diagram showing a preferred embodiment of the lighting system according to the present invention. As shown in FIG. 1, the present invention comprises a light source module 1 and a mixing assembly that in turn comprises a first mixing device 2, a second mixing device 3, and a third mixing device 4.

The lights produced by the light source module 1 are formed by mixing red-color, green-color, and blue-color lights in different proportions. The red-color, green-color, and blue-color lights are from light emitting devices within the light source module 1. In the present embodiment, the light emitting devices are red-color, green-color, and blue-color LEDs. By controlling the current injection into these LEDs, the luminous intensity of LEDs of a specific color could be adjusted independently. The proportions of the red-color, green-color, and blue-color lights in the white lights produced by the light source module 1, therefore, can be adjusted as well.

Figure 3A:
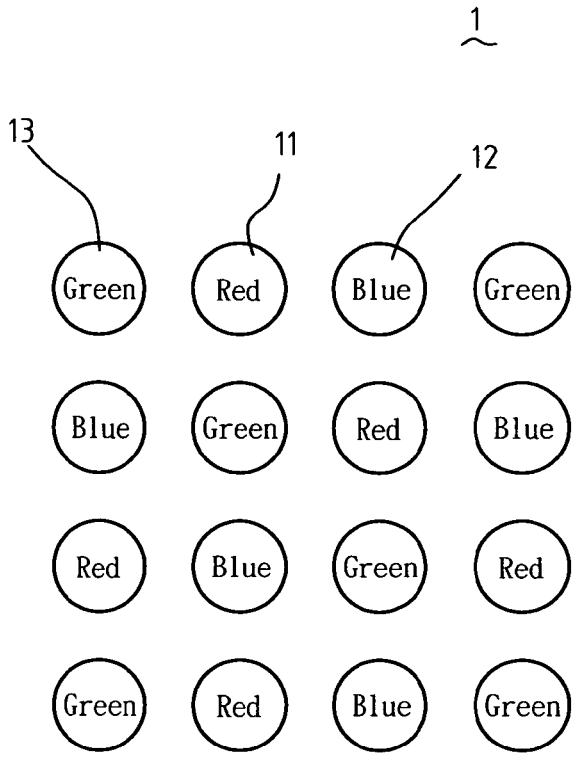
FIGS. 3*a* and 3*b* are schematic diagrams showing two possible arrangements of the LEDs within the light source module of the lighting system according to the present invention.
Figure 3B:
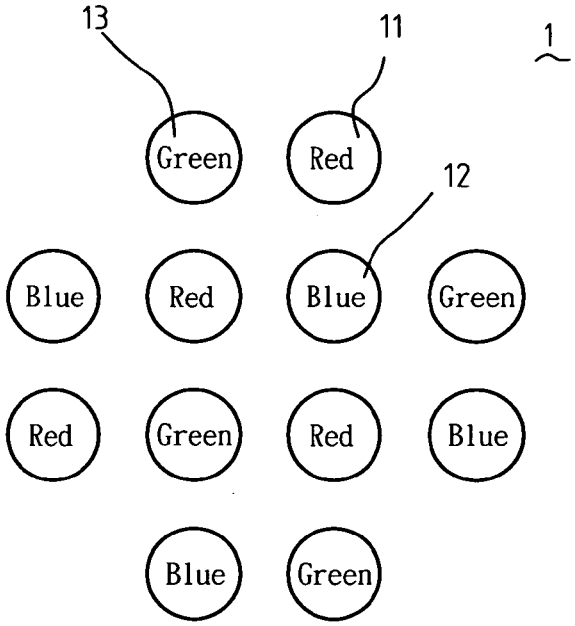

FIGS. 3*a* and 3*b* are schematic diagrams showing two possible arrangements of the LEDs within the light source module of the lighting system according to the present invention. As shown in FIGS. 3*a* and 3*b*, the light source module 1 is composed of pre-determined numbers of red LEDs 11, blue LEDs 12, and green LEDs 13, arranged in an evenly distributed and interleaving fashion. The arrangement shown in FIG. 3*a* is for matching a rectangular incident end of the first mixing device, and the arrangement shown in FIG. 3*b* is for matching a circular incident end of the first mixing device (more details later). The white lights produced by the light source module 1 are formed by mixing the red-color, green-color, and blue-color lights emitted from the LEDs 11, 12, 13. The luminous intensity of the white lights is determined by the numbers of these various colored LEDs and their patterns of arrangement. The color temperature of the white lights, on the other hand, is determined by the amounts of current injected into the various colored LEDs.

Figure 2:
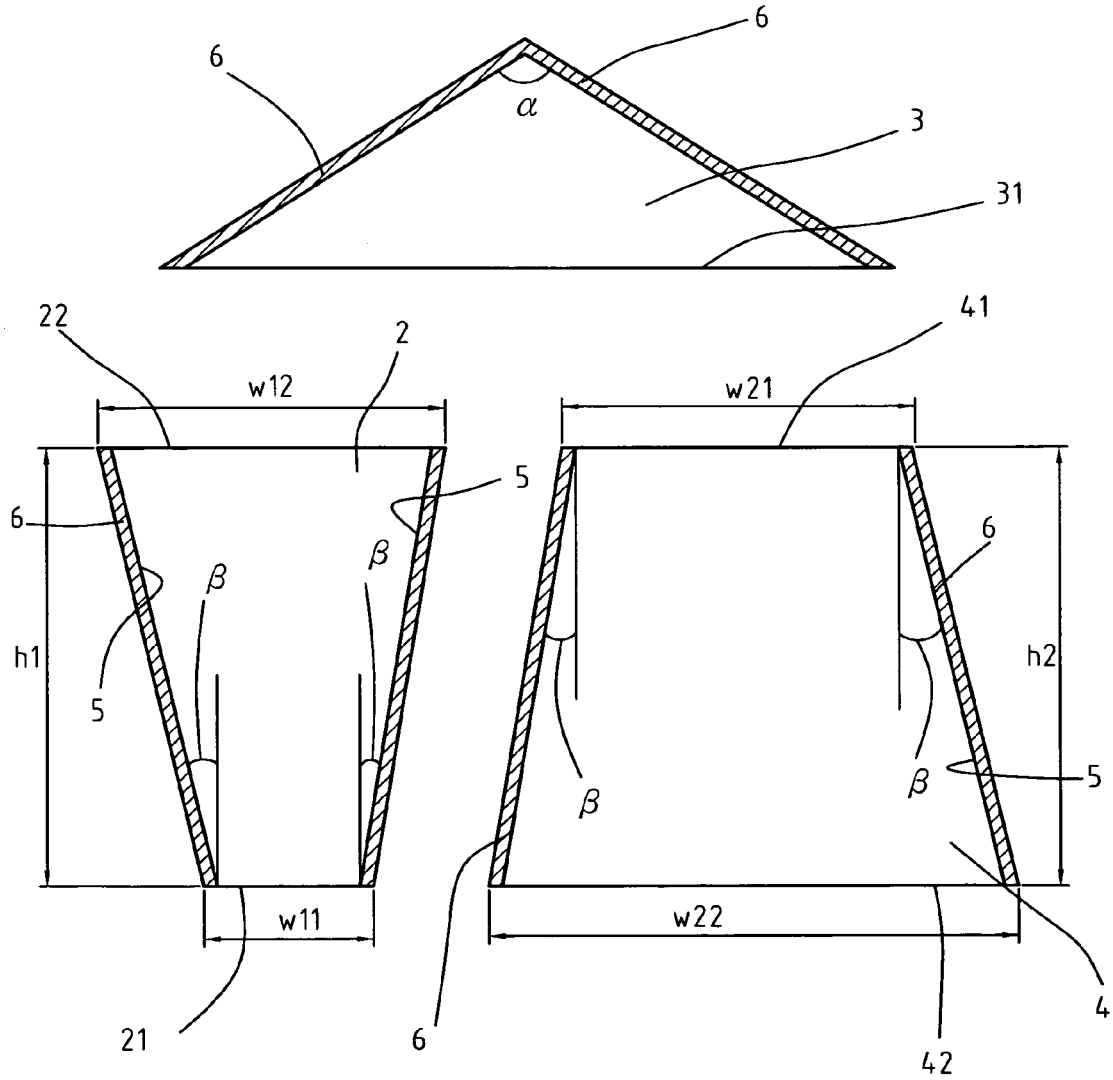
FIG. 2 is an explosion diagram showing the mixing assembly of the lighting system depicted in FIG. 1.

As shown in FIGS. 1 and 2, the mixing assembly is configured at a side to the light source module 1. The lights produced from the light source module 1 are directed into the mixing assembly and uniformly mixed by multiple reflections inside the mixing assembly. The mixing assembly comprises, sequentially along the lights' transmission path, a first mixing device 2, a second mixing device 3, and a third mixing device 4. The function of the first and third mixing devices 2, 4 is for light mixing, thus, causing the lights to undergo multiple internal reflections. The second mixing device 3 has an end attached to the first and third mixing devices 2, 4 and alters the lights' transmission path so that the dimensions of the first and third mixing devices 2, 4 can be reduced.

Geometrically, the first and third mixing devices 2, 4 are in the shape of a conoid, such as a cone or a polygonal conoid. For both the first and third mixing devices 2, 4, the wall of the conoid is inclined at an angle $\beta$ between 0° and 45°, and a material 6 having a high reflection index is coated on the wall's external surface. The conoid's two open ends are planar and the cross-section could be in the shape of circle, rectangle, or polygon (the LEDs in the light source module are arranged to match the shape here). An open end 22 of the first mixing device 2 and an open end 41 of the third mixing device 4 are attached to an end 31 of the second mixing device 3. The connecting ends 22 and 41 have identical shapes and areas.

In the present embodiment, the second mixing device 3 is a triangular prism. The prism has a vertex angle $\alpha$ between 60° and 120°, and the material 6 having a high reflection index is coated on the prism's external surface. As such, lights emitted out of the first mixing device 2 through the connecting end 22 are reflected into the third mixing device 4 via the connecting end 41.

The first, second, and third mixing devices 2, 3, 4 could be made of glass, or polymers, such as polycarbonate (PC), polystyrene (PS), and polymethylmethacrylate (PMMA). When using polymers, the mixing devices can be fabricated by injection molding so as to increase the yield and to lower the production cost. The material 6 could be silver, aluminum, or gold.

With reference to FIG. 2, the dimensions of the relevant parts of the mixing assembly are related as follows:

$$w12=w11+2\times h1\times\tan\beta$$

wherein, w11 is the incident end 21's aperture of the first mixing device 2, w12 is the connecting end 22's aperture of the first mixing device 2, and h1 is the height of the first mixing device 2; and $$w22=w21+2\times h2\times\tan\beta$$

wherein, w21 is the connecting end 41's aperture of the third mixing device 4, w22 is the emitting end 42's aperture of the third mixing device 4, h2 is the height of the third mixing device 4, and w12=w21.

From the foregoing description and dimension definitions of the relevant parts, a light's incident angle into the first mixing device 2 and the light's emitting angle out of the third mixing device 4 satisfy the following equations:

$$\sin^2(\theta_{in})\times(w11)^2=\sin^2(\theta_{out})\times(w22)^2,$$

$$w22=w11+2\times(h1+h2)\times\tan\beta$$

wherein, $\theta_{in}$ is the incident angle, and $\theta_{out}$ is the emitting angle.

Figure 4A:
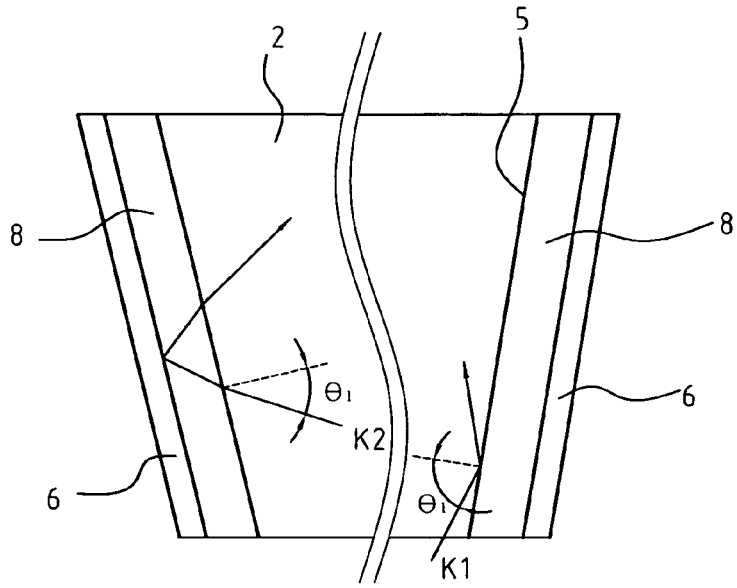
FIG. 4*a* is a schematic diagram showing two light transmission paths inside a mixing device of the lighting system according to the present invention.

In the present embodiment, the first and third mixing devices 2, 4 are for mixing lights uniformly by multiple internal reflections. The principles used behind the first and third mixing devices 2, 4 are identical and, therefore, only the operations of the first mixing device 2 are explained in the following. In general, reflection is caused by one of two types of mechanism. One is by totally internal reflection and the other one is by a material having a high reflection index. As shown in FIG. 4, the first mixing device 2 is mainly made of a material having a refraction index $n_2$. Around its wall, the first mixing device 2 has another medium layer 8 having a refraction index $n_1(n_2>n_1)$. On the external surface of medium layer 8, a material 6 having a high reflection index is coated. When a light k1 shoots on the internal surface 5, if k1's incident angle $\theta_1$ is greater than the total reflection angle $\sin^{-1}(n_1/n_2)$, total reflection would occur. If the incident angle $\theta_1$ is less than the total reflection angle $\sin^{-1}(n_1/n_2)$, as in the case of light k2, the light k2 would be refracted and enter the medium layer 8. When the light k2 touches the material 6 having a high reflection index, the light k2 would be reflected back into the first mixing device 2. After such repetitive reflection and mixing, a light with high uniformity can be produced.

In addition, to mix red, green, and blue lights into a uniform white light, each of the three component lights must be reflected inside the mixing assembly up to a specific number of times. If the mixing assembly contains only one mixing device, the mixing device must have a longer dimension to provide the specific number of reflections. To overcome the shortcoming of longer dimension and therefore larger form factor, the present embodiment utilizes a prism as the second mixing device 3 to alter the light transmission path so that, on one hand, the specific number of reflections is attainable to produce uniform light mixing and, on the other hand, the dimension of the first and third mixing devices 2, 4 and, therefore, the overall dimension of the lighting system, can be reduced.

Figure 4B:
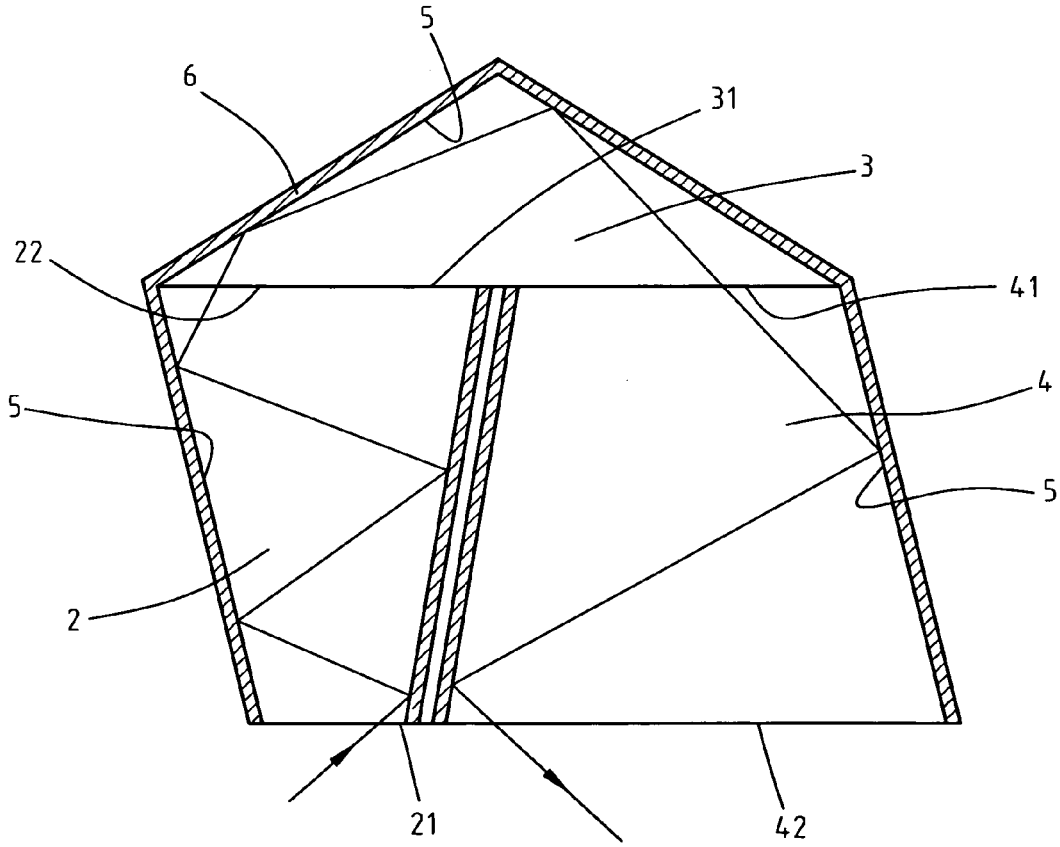
FIG. 4*b* is a schematic diagram showing a light transmission path inside the lighting system according to the present invention.

In summary, the present invention utilizes the light source module 1 to produce lights with the required color temperature. In other words, the color temperature can be adjusted freely based on requirements. Then, as shown in FIG. 4*b*, the present invention utilizes the mixing assembly to have the lights with the required color temperature reflected and mixed multiple times by the first mixing device 2. The lights are then reversed by the second mixing device 3 into the third mixing device 4, where the lights would undergo additional reflection and mixing. In the end, highly uniform white lights from mixing red-color, blue-color, and green-color lights are emitted out of the third mixing device 4.

To verify the feasibility of the present invention, the following experiment is conducted.

Figure 5:
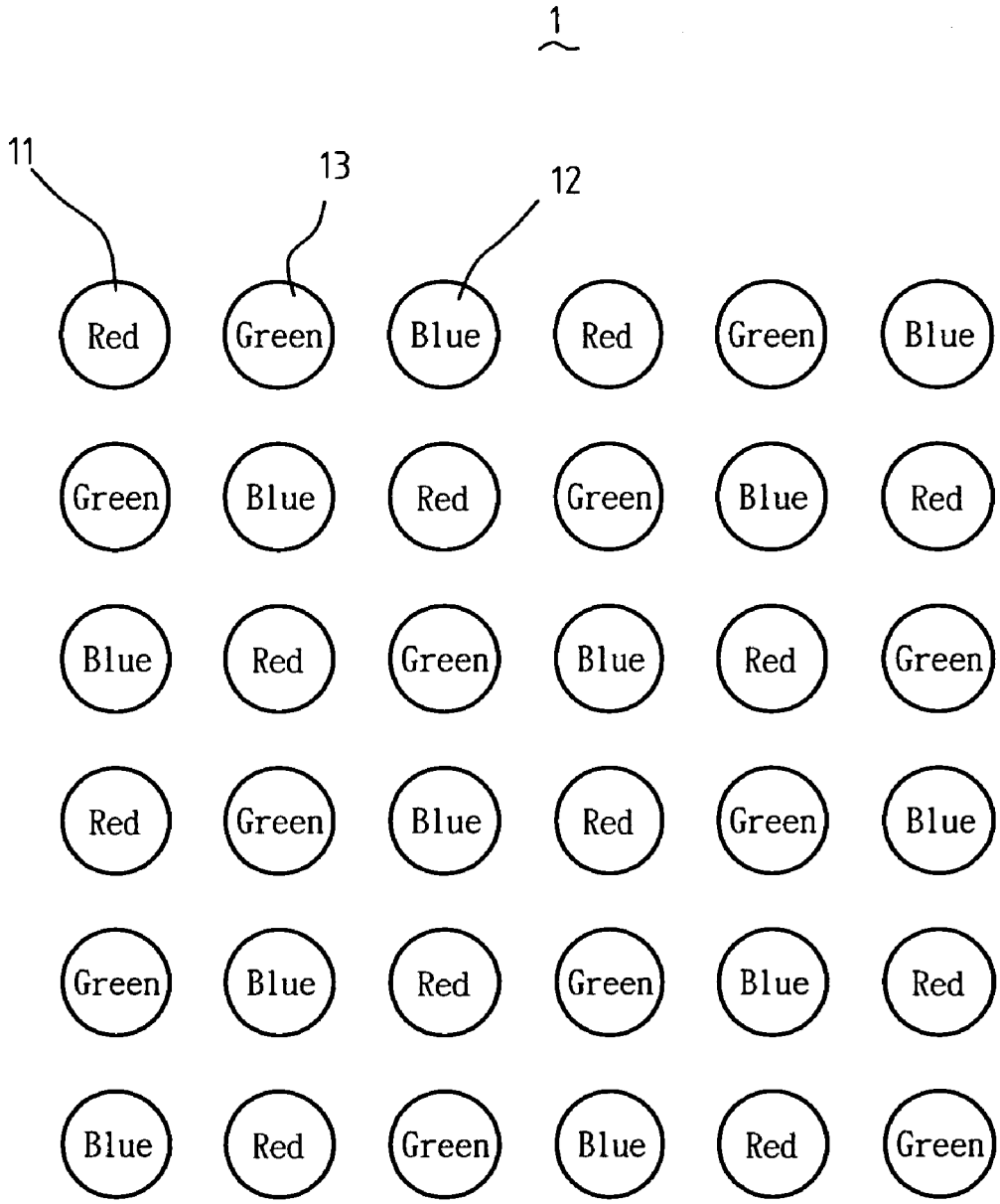
FIG. 5 is a schematic diagram showing the arrangement of 36 LEDs within the light source module of the lighting system according to the present invention.

Both the first and third mixing devices 2, 4 have an inclination angle β of 10° and a height of 7.5 cm. The incident end 21's aperture w11 of the first mixing device 2 is 2.4 cm and the connecting end 22's aperture w12 is 5 cm. The connecting end 41's aperture w21 of the third mixing device 4 is 5 cm and the emitting end 42's aperture w22 is 7.6 cm. The light source module 1 is composed of an array of 36 LEDs, as shown in FIG. 5. Both the first (incident) and third (emitting) mixing devices 2, 4 have a rectangular cross-section. Then, according to measurements made during the experiment, the luminous intensity of different colored lights emitted out of the mixing assembly is evenly distributed and has very limited variance. This result means, when the red-color, blue-color, and green-color LEDs in the light source module 1 are lighted simultaneously, a uniform white light is produced by the lighting system according to the present invention.

Figure 6:
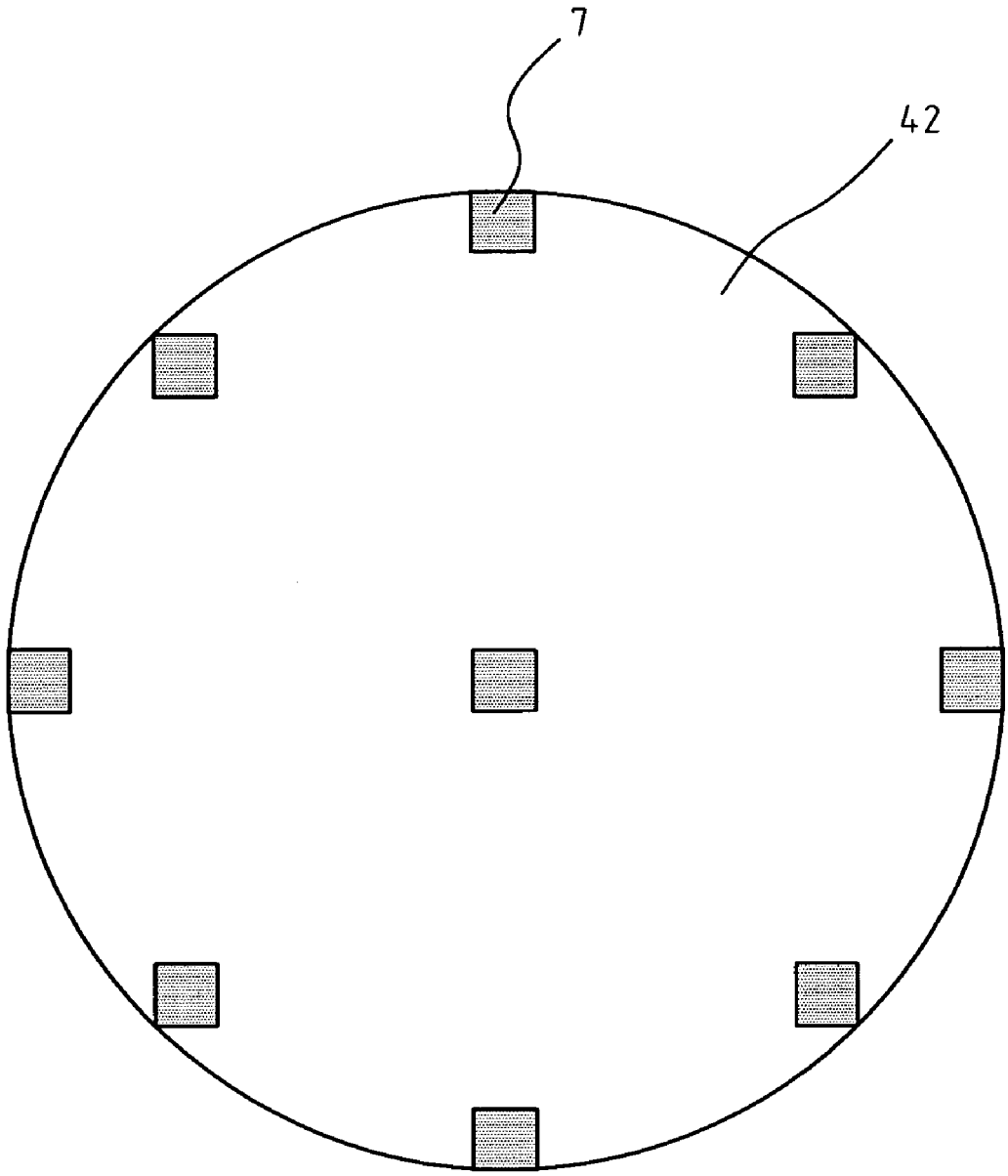
FIG. 6 is a schematic diagram showing the locations of detectors in an image plane's viewing area.
Figure 7:
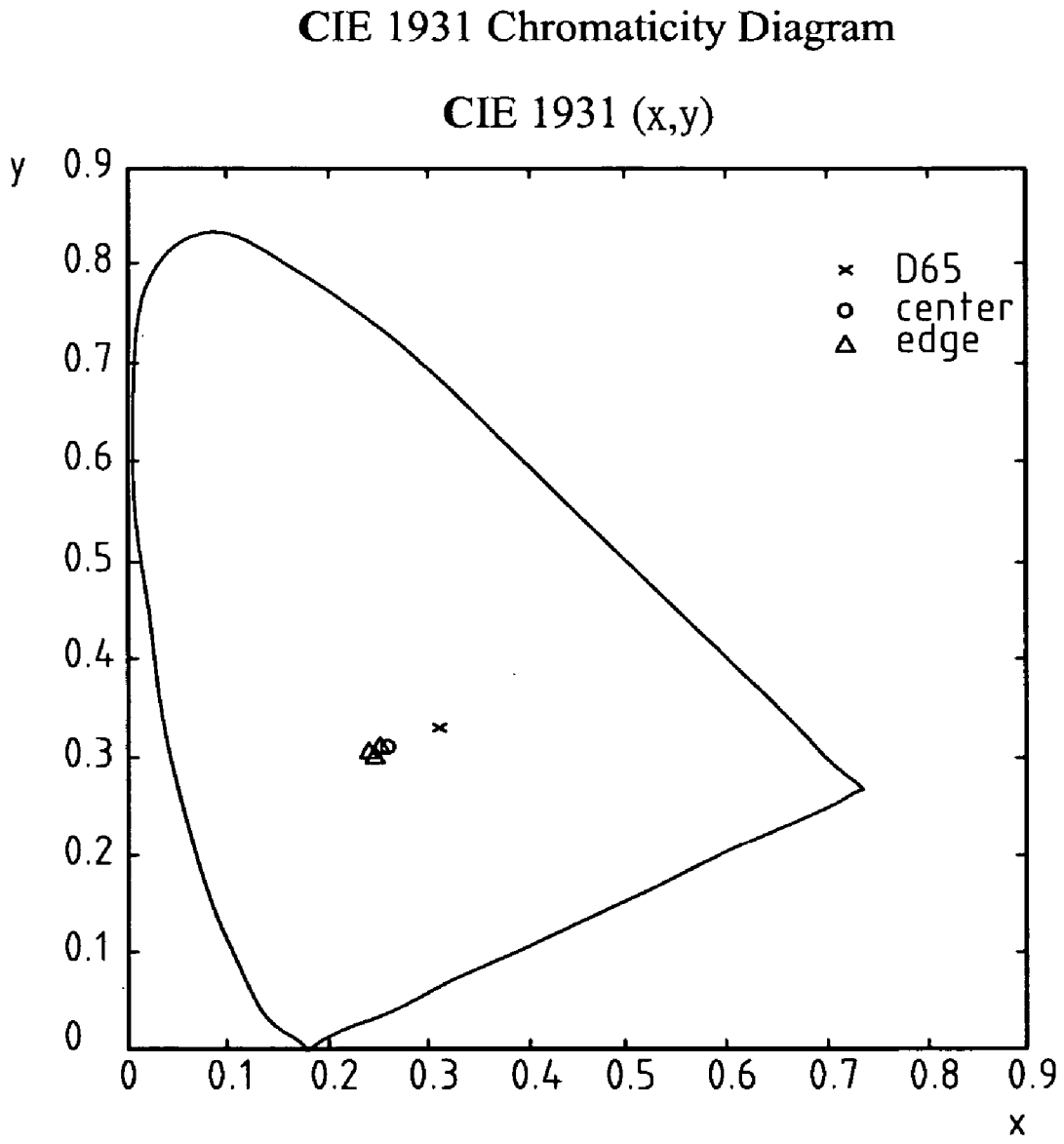
FIG. 7 is the CIE 1931 chromaticity diagram plotted with the data measured by the detectors depicted in FIG. 6.

The measurement is conducted as shown in FIG. 6. Nine detectors 7 are located at the rim and center of an image plane's viewing area. Based on the colorimetry formulas, the data collected by each of the detectors 7 can be calculated into a (x, y) coordinate in the CIE 1931 chromaticity diagram. The measurement data from the detectors 7 and their corresponding (x, y) coordinates in the CIE 1931 chromaticity diagram are listed and plotted in Table 1 and FIG. 7. As shown in FIG. 7, the (x, y) coordinates are all clustered together in the CIE 1931 chromaticity diagram. This means that the white lights measured at the rim and center of the image plane's viewing area are almost identical.

TABLE 1

| Detector | Measured data | | | Coordinate in CIE 1931 | |
|---|---|---|---|---|---|
| location | X | Y | Z | x | y |
| Center | 83.2 | 100 | 142 | 0.26 | 0.308 |
| Top | 69.1 | 82.6 | 127 | 0.248 | 0.207 |
| Upper right | 79.2 | 85.3 | 122 | 0.253 | 0.308 |
| Right | 67.9 | 83.4 | 127 | 0.244 | 0.299 |
| Lower right | 67.7 | 81.5 | 123 | 0.248 | 0.299 |
| Down | 64.3 | 78.2 | 120 | 0.245 | 0.298 |
| Lower left | 66.8 | 80.7 | 116 | 0.253 | 0.306 |
| Left | 64.7 | 78.5 | 121 | 0.246 | 0.298 |
| Upper left | 67.5 | 81.2 | 124 | 0.247 | 0.298 |

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A lighting system capable of adjusting color temperature, comprising:

a light source module for producing red-color, blue-color, and green-color lights so as to control a color temperature of a white light resulted from mixing said color lights; and a mixing assembly located at a side of said light source module producing a white light with a required color temperature by uniformly mixing said color lights after causing said color lights to undergo a plurality of reflections within said mixing assembly, said mixing assembly comprising:

a first mixing device accepting said color lights from said light source module and causing said color lights to undergo a plurality of reflections before entering a second mixing device, said second mixing device accepting said color lights from said first mixing device and altering said color lights' paths to enter a third mixing device by causing said color lights to undergo a plurality of reflections, and said third mixing device accepting said color lights from said second mixing device and output said color lights after causing said color lights to undergo a plurality of reflections;

wherein an incident light into an incident end of said first mixing device and an emitting light out of an emitting end of said third mixing device satisfy the following equations:

$$\sin^2(\theta_{in})\times(w11)^2=\sin^2(\theta_{out})\times(w22)^2,$$

$$w22=w11+2\times(h1+h2)\times\tan\beta$$

wherein,

βis said first and said third mixing devices' wall inclination angle, w11 is said incident end's aperture of said first mixing device, w22 is said emitting end's aperture of said third mixing device, h1 is said first mixing device's height, h2 is said third mixing device's height, $\theta_{in}$ is said incident light's incident angle, and $\theta_{out}$ is said emitting light's emitting angle.

2. The lighting system as claimed in claim 1, wherein said light source module is composed of at least one red-color LED, at least one blue-color LED, and at least one green-color LED, and said color LEDs are arranged in an evenly distributed and interleaving fashion.

3. The lighting system as claimed in claim 1, wherein a connecting end of said first mixing device attached to said second mixing device and a connecting end of said third mixing device attached to said second mixing device have identical shapes and areas.

4. The lighting system as claimed in claim 1, wherein said first mixing device and said third mixing device are in the shape of a cone whose two open ends are circular and whose wall is inclined at an angle between 0° and 45°.

5. The lighting system as claimed in claim 1, wherein said first mixing device and said third mixing device are in the shape of a polygonal conoid whose two open ends are polygonal and whose wall is inclined at an angle between 0° and 45°.

6. The lighting system as claimed in claim 1, wherein said second mixing device is a prism.

7. The lighting system as claimed in claim 6, wherein said prism is a triangular prism.

8. The lighting system as claimed in claim 6, wherein said prism's vertex angle is between 60° and 120°.

9. The lighting system as claimed in claim 1, wherein said first and said third mixing devices are made of a material selected from the group consisting of glass, polycarbonate, polystyrene, and polymethylmethacrylate.

10. The lighting system as claimed in claim 1, wherein a material having a high reflection index is coated on said first, said second, and said third mixing devices' reflective surfaces.

11. The lighting system as claimed in claim 10, wherein said material having a high reflection index is selected from the group consisting of silver, aluminum, and gold.

* * * * *